US008991070B2

(12) United States Patent
Kray

(10) Patent No.: US 8,991,070 B2
(45) Date of Patent: Mar. 31, 2015

(54) SHOE AND METHOD OF MAKING SAME

(75) Inventor: Carlos Henrique Kray, Campo Bom (BR)

(73) Assignee: Strada Shoe Limitada, Campo Bom RS (BR)

( * ) Notice: Subject to any disclaimer, the term of this patent is extended or adjusted under 35 U.S.C. 154(b) by 836 days.

(21) Appl. No.: 12/838,241

(22) Filed: Jul. 16, 2010

(65) Prior Publication Data

US 2011/0010966 A1 Jan. 20, 2011

Related U.S. Application Data

(60) Provisional application No. 61/226,013, filed on Jul. 16, 2009.

(51) Int. Cl.

| | |
|---|---|
| ***A43B 3/10*** | (2006.01) |
| ***A43B 5/12*** | (2006.01) |
| ***A43B 11/00*** | (2006.01) |
| ***A43B 23/07*** | (2006.01) |
| ***A43B 23/00*** | (2006.01) |
| ***A43B 5/00*** | (2006.01) |
| ***A43B 13/14*** | (2006.01) |
| ***A43B 23/02*** | (2006.01) |
| ***A43B 23/22*** | (2006.01) |
| ***A43C 1/00*** | (2006.01) |

(52) U.S. Cl.

CPC . *A43B 5/12* (2013.01); *A43B 13/14* (2013.01); *A43B 23/0245* (2013.01); *A43B 23/028* (2013.01); *A43B 23/07* (2013.01); *A43B 23/22* (2013.01); *A43C 1/00* (2013.01)

USPC ..... 36/10; 36/8.3; 36/50.1; 36/55; 36/25 R; 36/45

(58) Field of Classification Search

CPC ..... A43B 3/12; A43B 3/26; A43B 5/12; A43B 5/0405; A43B 13/16; A43B 13/141; A43B 23/07; A43B 23/026; A43B 23/08; A43B 13/14

USPC ..... 36/25 R, 55, 69, 8.3, 10, 89, 88, 45, 36/50.1, 136, 9 R, 11; 12/146 B, 146 C

See application file for complete search history.

(56) References Cited

U.S. PATENT DOCUMENTS 205,129 A * 6/1878 Packard ..... 36/50.1
563,629 A * 7/1896 Toal ..... 36/48

(Continued)

FOREIGN PATENT DOCUMENTS

WO 02087374 A1 11/2002

OTHER PUBLICATIONS

PCT International Search Report and Written Opinion in corresponding application PCT/US10/42343 mailed Sep. 23, 2010.

*Primary Examiner* — Shaun R Hurley
*Assistant Examiner* — Cameron A Carter
(74) *Attorney, Agent, or Firm* — Edell, Shapiro & Finnan, LLC

(57) ABSTRACT

The present invention is directed toward a shoe including an outsole, an upper, and a lining member integrated into the shoe. The sling includes a receptacle portion and a fastener assembly portion. The receptacle portion, which generally lines the interior of the shoe, is secured along the collar of the upper such that the sock is movably suspended within the foot cavity. The fastener assembly is includes a central web and fasteners that wrap around the ankle of a wearer.

18 Claims, 9 Drawing Sheets

(56) References Cited

U.S. PATENT DOCUMENTS

| | | | | | |
|---|---|---|---|---|---|
| 1,754,054 | A | | 6/1927 | Selva | |
| 1,712,420 | A | * | 5/1929 | Carlson | 36/58.5 |
| 2,110,890 | A | * | 3/1938 | Paul | 36/8.3 |
| 2,526,663 | A | * | 10/1950 | Holland | 2/239 |
| 2,582,910 | A | * | 1/1952 | Lyon | 36/109 |
| 2,619,743 | A | * | 12/1952 | Harris | 36/8.3 |
| 2,683,316 | A | * | 7/1954 | Reker et al. | 36/8.3 |
| 3,327,410 | A | * | 6/1967 | Park, Sr. et al. | 36/89 |
| 3,601,909 | A | * | 8/1971 | Amendola | 36/44 |
| 3,739,414 | A | | 6/1973 | Skelham | |
| 3,797,137 | A | | 3/1974 | Harkness | |
| 4,026,046 | A | | 5/1977 | Clark et al. | |
| 4,453,996 | A | | 6/1984 | Terlizzi, Jr. et al. | |
| 4,519,148 | A | | 5/1985 | Sisco | |
| 4,901,453 | A | | 2/1990 | Gaynor | |
| 5,257,969 | A | * | 11/1993 | Mance | 602/28 |
| RE34,890 | E | | 4/1995 | Sacre | |
| 5,511,323 | A | | 4/1996 | Dahlgren | |
| 5,595,005 | A | * | 1/1997 | Throneburg et al. | 36/91 |
| 5,802,742 | A | * | 9/1998 | Baude et al. | 36/117.6 |
| 6,202,324 | B1 | * | 3/2001 | Whitlock | 36/7.1 R |
| 6,361,514 | B1 | | 3/2002 | Brown | |
| 6,442,874 | B1 | | 9/2002 | Long | |
| 6,560,898 | B2 | * | 5/2003 | Borsoi et al. | 36/10 |
| 6,588,124 | B2 | | 7/2003 | Morrone | |
| 6,691,431 | B2 | * | 2/2004 | Farrior | 36/8.3 |
| 6,705,026 | B1 | * | 3/2004 | Arbour | 36/8.3 |
| 7,243,444 | B2 | | 7/2007 | Selner | |
| 7,254,904 | B2 | * | 8/2007 | Nye | 36/8.3 |
| 7,334,354 | B2 | | 2/2008 | Foxen | |
| 7,370,438 | B2 | * | 5/2008 | Vattes et al. | 36/10 |
| 7,434,336 | B2 | * | 10/2008 | Kosted | 36/10 |
| 7,921,579 | B1 | * | 4/2011 | French | 36/8.3 |
| 8,056,149 | B2 | * | 11/2011 | Duclos | 2/239 |
| 8,082,682 | B2 | * | 12/2011 | Karl et al. | 36/8.3 |
| 8,127,466 | B1 | * | 3/2012 | Raval | 36/8.3 |
| 8,196,317 | B2 | * | 6/2012 | Dua et al. | 36/50.1 |
| 2003/0033729 | A1 | * | 2/2003 | Farrior | 36/8.3 |
| 2003/0070319 | A1 | * | 4/2003 | Minden | 36/8.3 |
| 2004/0226076 | A1 | * | 11/2004 | Chen | 2/239 |
| 2005/0115111 | A1 | * | 6/2005 | Yamashita et al. | 36/89 |
| 2005/0198861 | A1 | * | 9/2005 | Nye | 36/8.3 |
| 2006/0112595 | A1 | * | 6/2006 | Vattes et al. | 36/55 |
| 2006/0137223 | A1 | * | 6/2006 | Ziccarelli | 36/55 |
| 2007/0000149 | A1 | * | 1/2007 | Juniman | 36/8.3 |
| 2007/0118974 | A1 | * | 5/2007 | Hexels | 2/239 |
| 2007/0199208 | A1 | * | 8/2007 | Wilkenfeld | 36/8.3 |
| 2008/0034612 | A1 | * | 2/2008 | Palattella | 36/8.3 |
| 2008/0034613 | A1 | * | 2/2008 | Wilkenfeld et al. | 36/8.3 |
| 2008/0086912 | A1 | * | 4/2008 | Wilkenfeld | 36/92 |
| 2009/0031582 | A1 | * | 2/2009 | Lu | 36/10 |
| 2009/0151200 | A1 | * | 6/2009 | Niedermeyer et al. | 36/88 |

* cited by examiner

SHOE AND METHOD OF MAKING SAME

CROSS REFERENCE TO RELATED APPLICATIONS

This application is a nonprovisional application of U.S. Provisional Application No. 61/226,013, filed 16 Jul. 2009 and entitled "Shoe and Method of Making Same." The disclosure of this provisional application is hereby incorporated by reference in its entirety.

FIELD OF THE INVENTION

The present invention relates generally to shoes, and, in particular, to a shoe including an integrated sling operable to move within the shoe, as well as to a method of forming a shoe.

SUMMARY OF THE INVENTION

The present invention is directed toward a shoe with a sling or lining member integrated into the shoe. The shoe includes an upper and a sole that define an interior shoe cavity operable to receive a foot. The sling includes a receptacle and a fastener assembly. The sling is secured to the collar such that the receptacle is suspended with the shoe cavity, moving freely therein. The fastener assembly is configured to wrap around the leg/ankle of a foot. The fastener assembly includes a central web and one or more fastener members. In operation, the central web extends above the shoe collar to generally cover the Achilles tendon of the foot, while the fastener members are wrapped around the ankle of the foot and secured to each other on the side of the ankle opposite the central web.

BRIEF DESCRIPTION OF THE DRAWINGS

Like reference numbers have been utilized to identify like components throughout the figures.

DETAILED DESCRIPTION OF THE INVENTION

Figure 1A:
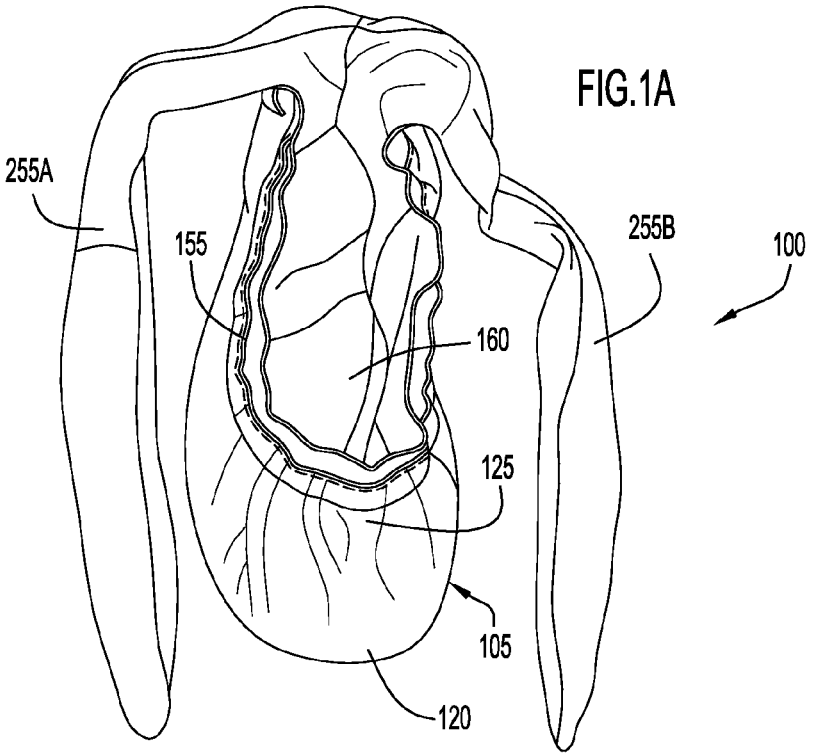
FIG. 1A illustrates a front perspective view of a shoe including a sling in accordance with an embodiment of the invention.
Figure 1B:
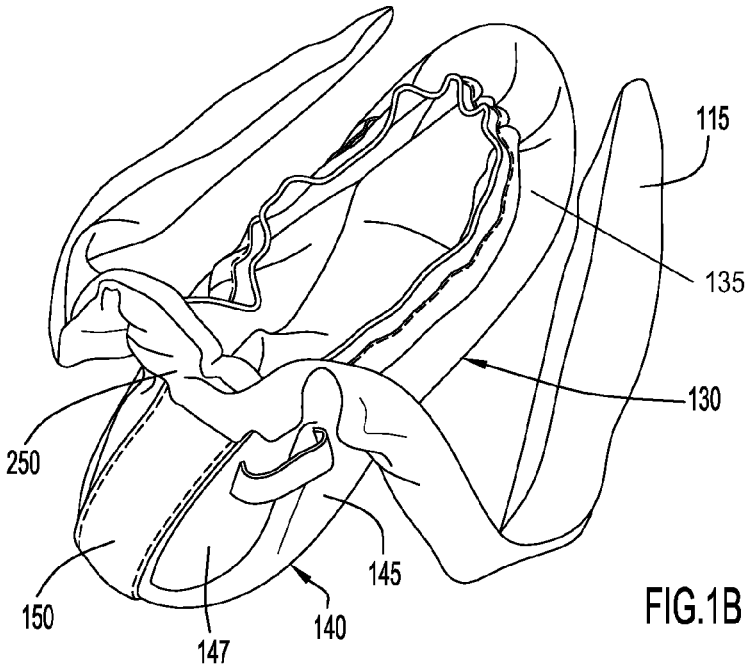
FIG. 1B illustrates a rear perspective view of the shoe shown in FIG. 1A.
Figure 1C:
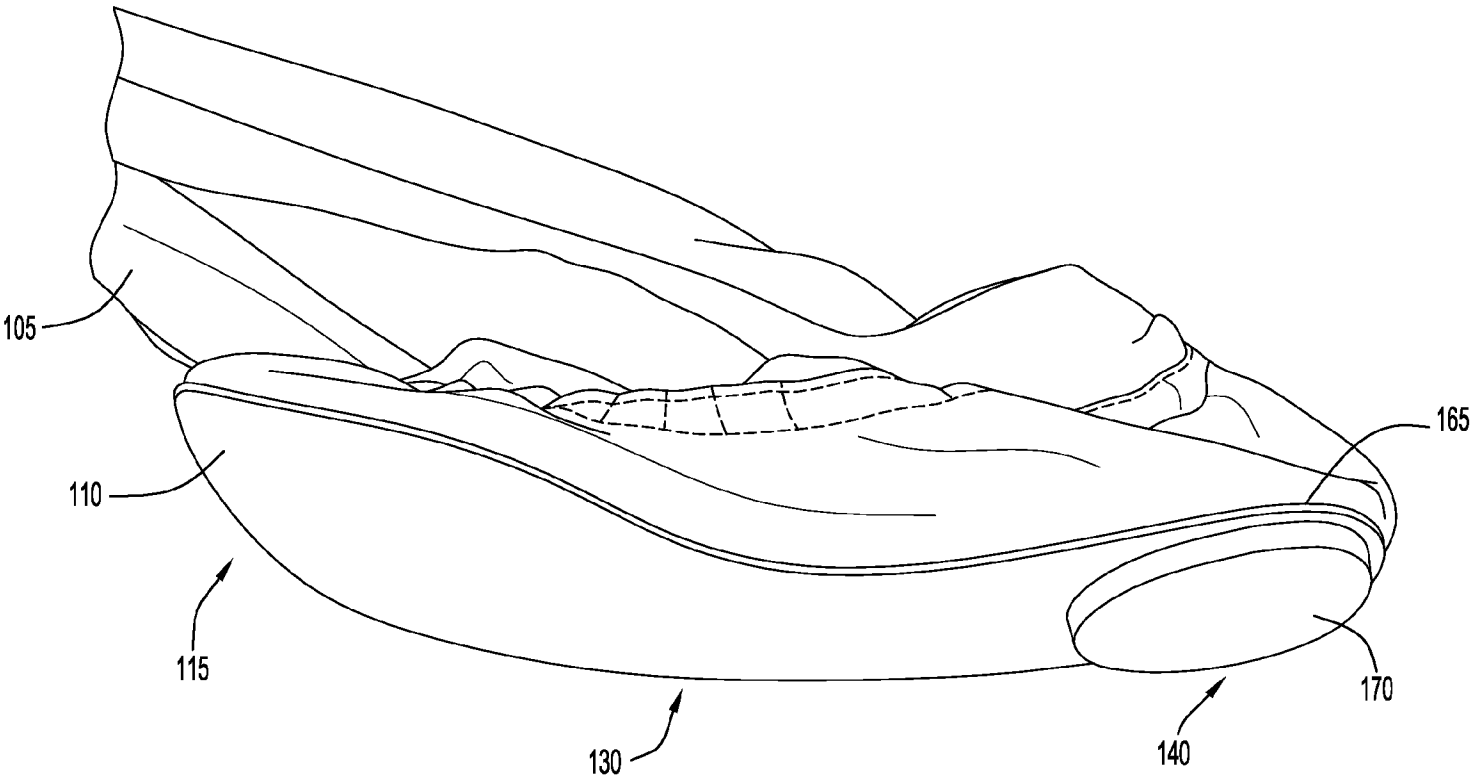
FIG. 1C illustrates a side perspective view of the shoe shown in FIG. 1A.

FIGS. 1A-1C illustrate a shoe in accordance with an embodiment of the invention. As illustrated, the shoe 100 includes an upper 105 and a sole 110. The front or forefoot portion 115 of the upper 105 includes a toe cap 120 disposed at its front and a throat 125 disposed rearward of the toe cap. The intermediate portion 130 of the upper 105 is defined by the vamp 135 (i.e., the section of the upper disposed rearward of the throat 125 that covers the front of the foot as far back as the quarter). The rear or heel portion 140 of the upper 105 substantially envelops the heel of the foot. The heel portion 140 includes the quarter 145 with a heel cap 147 and an optional counter 150 (a generally vertical strip of material aligned with the longitudinal axis of the shoe that is configured to strengthen the quarter).

An ankle collar or cuff 155 is formed into the top of the upper 105, extending forward from the heel portion 140 to the front portion 115, terminating proximate the throat 125. The ankle collar 155 defines a foot opening 160 that permits the passage of foot into the shoe. The ankle collar 155 further serves as the point of attachment for a stretchable sling (discussed in greater detail below).

With the above-described configuration, the upper 105 and the sole 110 cooperate to define a foot or shoe cavity 315 (FIG. 3) that receives the foot of the wearer.

The upper 105 is secured to the sole 110 around its bottom edge 545 (FIG. 5B) along a joint or feather 165, e.g., by stitching, adhesive bonding, a welt (a strip of material that joins the upper to the sole), etc. The sole 110 defines an interior surface or insole 300 (FIG. 3) that faces the bottom of the foot and an exterior surface or outsole 305(FIG. 3) that faces the walking surface. The shoe 100 may further include a pad coupled to the insole 300 to provide additional cushioning to the shoe.

The rear section of the sole 110 may include a heel 170 configured to support the heel of the foot, raising the rear of the shoe 100 in relation to the front. The heel 170 may possess any shape and any dimensions suitable for its described purpose. The heel 170 typically includes a top piece that touches ground, a heel seat connected to outsole, and a front-facing surface or breast.

In one embodiment, the sole 110 is configured as a full sole, extending continuously from the heel cap 147 to toe cap 120. In another embodiment, the sole 110 may be configured as a split sole, wherein a first sole section is disposed within the heel portion 140 and a second sole section disposed within the forefoot portion 115 (i.e., no sole is positioned along the part of the shoe located under the arch of the foot).

Figure 2:
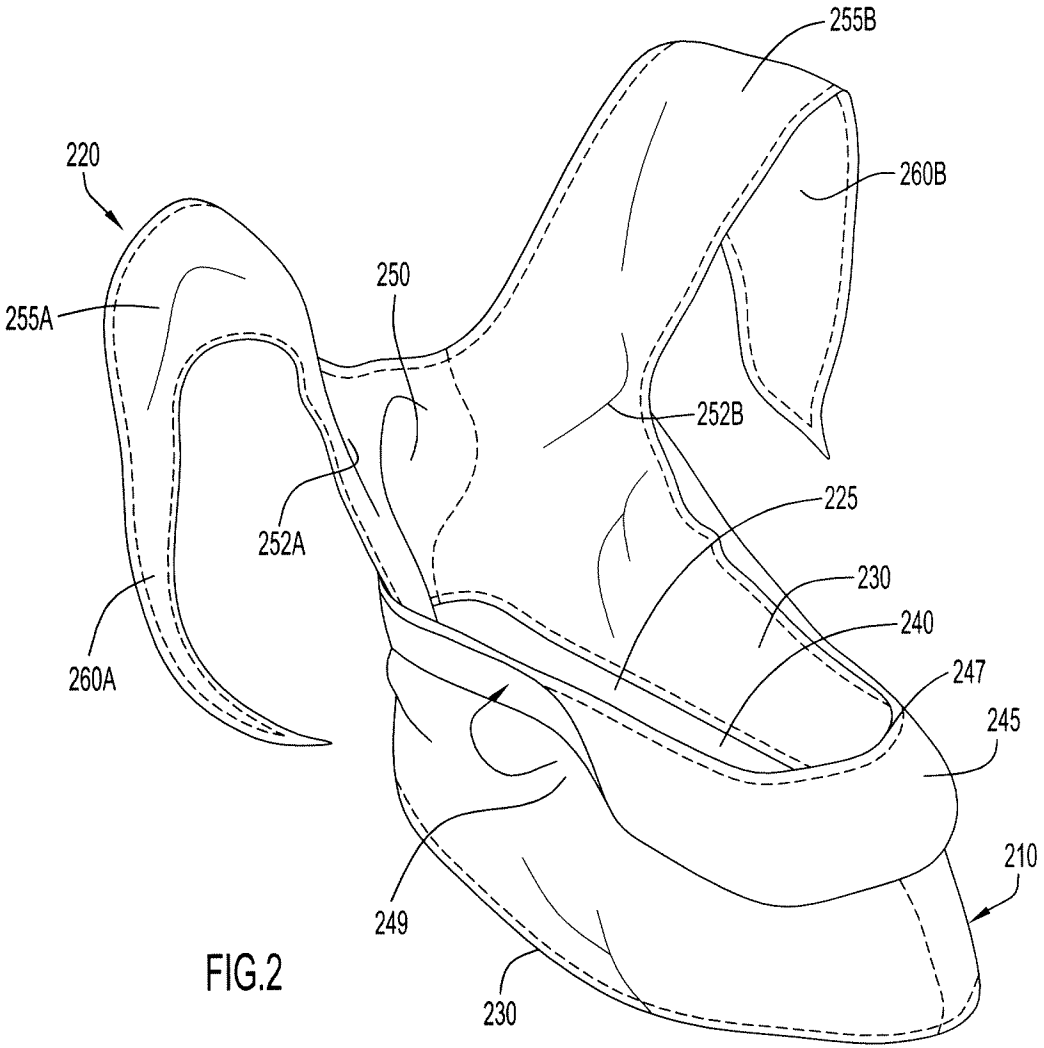
FIG. 2 illustrates an isolated view of the sling in accordance with an embodiment of the invention.

The shoe 100 further includes a flexible/stretchable sling or liner permanently secured to the upper 105. In the embodiment shown in FIG. 2, the sling 200 possesses a unitary structure including a foot receptacle 210 and a fastener assembly 220. The foot receptacle 210 is configured to generally conform to the shape of the shoe cavity 315. The foot receptacle 210 includes a bottom or base 225 and a side wall 230 extending upward from the base. The base 225, which defines a generally horizontal surface in contact with the bottom of the foot, is substantially coextensive with the insole 300 of the sole 105. The side wall 230 may be connected to the base 225 along a seam 235 (e.g., via stitching), and may be angularly or orthogonally oriented with respect to the base 225. With this configuration, the foot receptacle 210 is configured to be generally coextensive with the cavity 315 of the shoe 100, further defines a sling cavity 240 (FIG. 3) that receives the foot of a wearer.

Figure 5A:
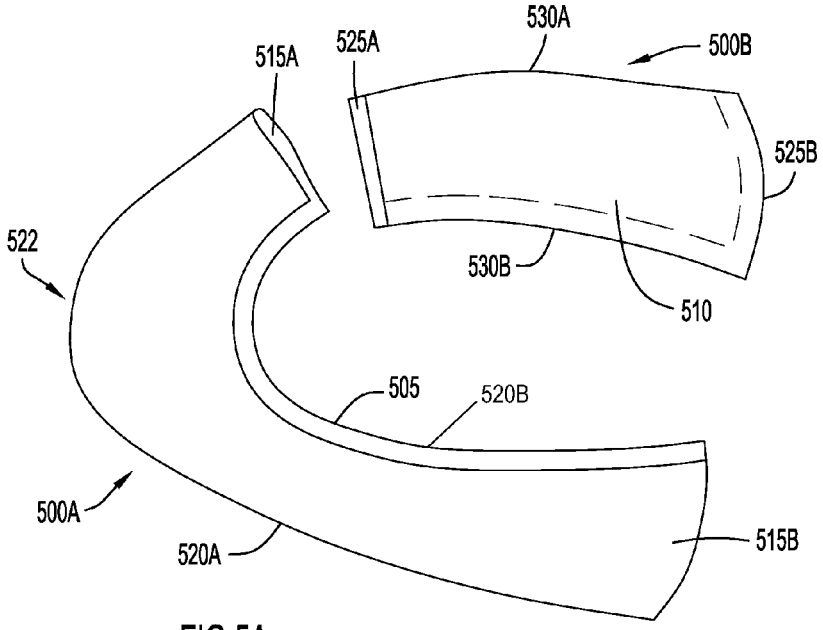
FIGS. 5A and 5B illustrate the formation of the upper.
Figure 5B:
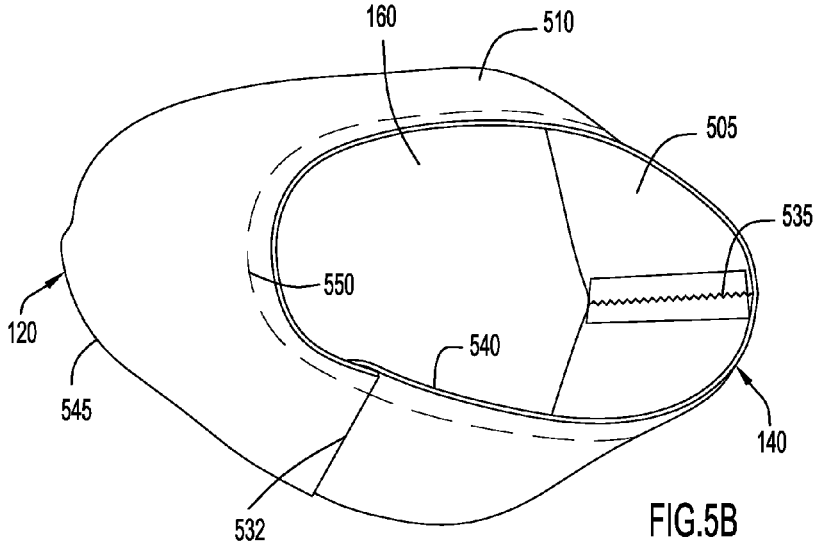
Figure 5C:
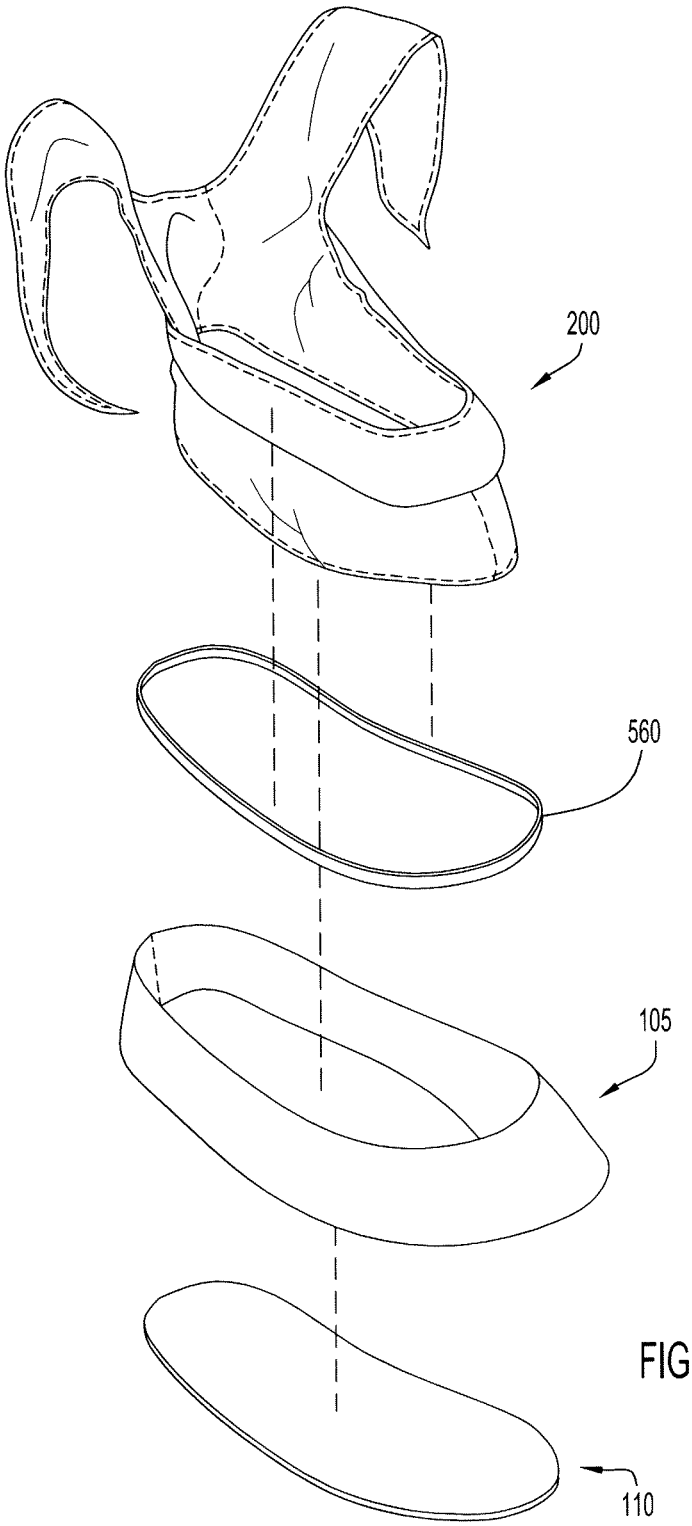
FIG. 5C illustrates an exploded view of the shoe of FIG. 1A, showing the interrelationship of components forming the shoe.

The sling 200 may further include an exterior flap 245 extending from the rim 247 of the receptacle 210. The flap 245 extends downward from the perimeter of the receptacle 210 such that it overlaps the receptacle's upper portion. With this configuration, the flap 245 generally defines a pocket 249 configured to receive and capture an elastic member or band 560 (FIG. 5C). The elastic member is coupled to the collar 155 of the sole 105 to provide a resilient opening that partially closes on the foot, helping to secure to shoe 100 thereto. In operation, the band 560 is positioned within the pocket 249. The flap 245 is secured to the receptacle 210, which, in turn, is secured to the upper 105 along a line falling just below the collar 155.

The fastener assembly 220 is configured to wrap around the leg/ankle of the wearer. The fastener includes a central web 250 configured to extend upward from collar 155 proximate the heel portion 140 of the upper 105 (e.g., being centrally aligned with the counter 150 (seen best in FIG. 6)). The central web 250 may further include a first lateral portion 252A disposed along a first lateral side of the web and a second lateral portion 252B disposed along a second lateral side of the web. With this configuration, the central web 250 and lateral portions 252A, 252B partially surround the rear potion of the opening 160 defined by collar 155 (being positioned along the heel cap 147). The central web 250 may possess any shape and dimensions suitable for its described purpose. Preferably, the central web 250 is configured to cover at least a portion of the Achilles tendon of the wearer.

A first fastener member 255A may extend from the first lateral portion 252A of the central web 250, while a second fastener member 255B may extend from the second lateral portion 252B of the central web. Each fastener member 255A, 255B extends distally from the central web 250 to define a distal portion 260A, 260B disposed a predetermined distance from the web. Each fastener member 255A, 255B may be configured to extend laterally from the central web 250 at an angle oriented generally orthogonal to the longitudinal axis of the shoe 100. Alternatively, the fastener member 255A, 255B may extend from the central web 250 at other desired angles. Each fastener member 255A, 255B is configured to wrap around the lateral side of the leg/ankle and be fastened to each other along the side of the ankle/leg generally opposite to the central web 250.

Figure 3:
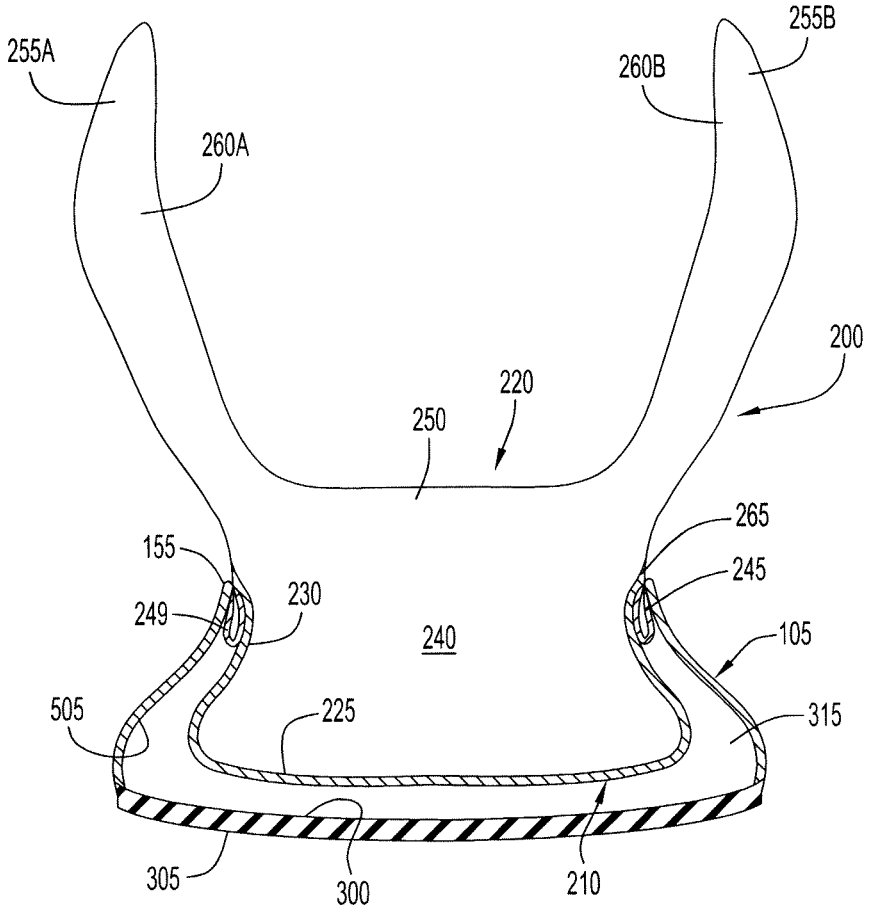
FIG. 3 illustrates a front cross-sectional view of the shoe of FIG. 1A, showing the sling connected to the collar of the upper.
Figure 4:
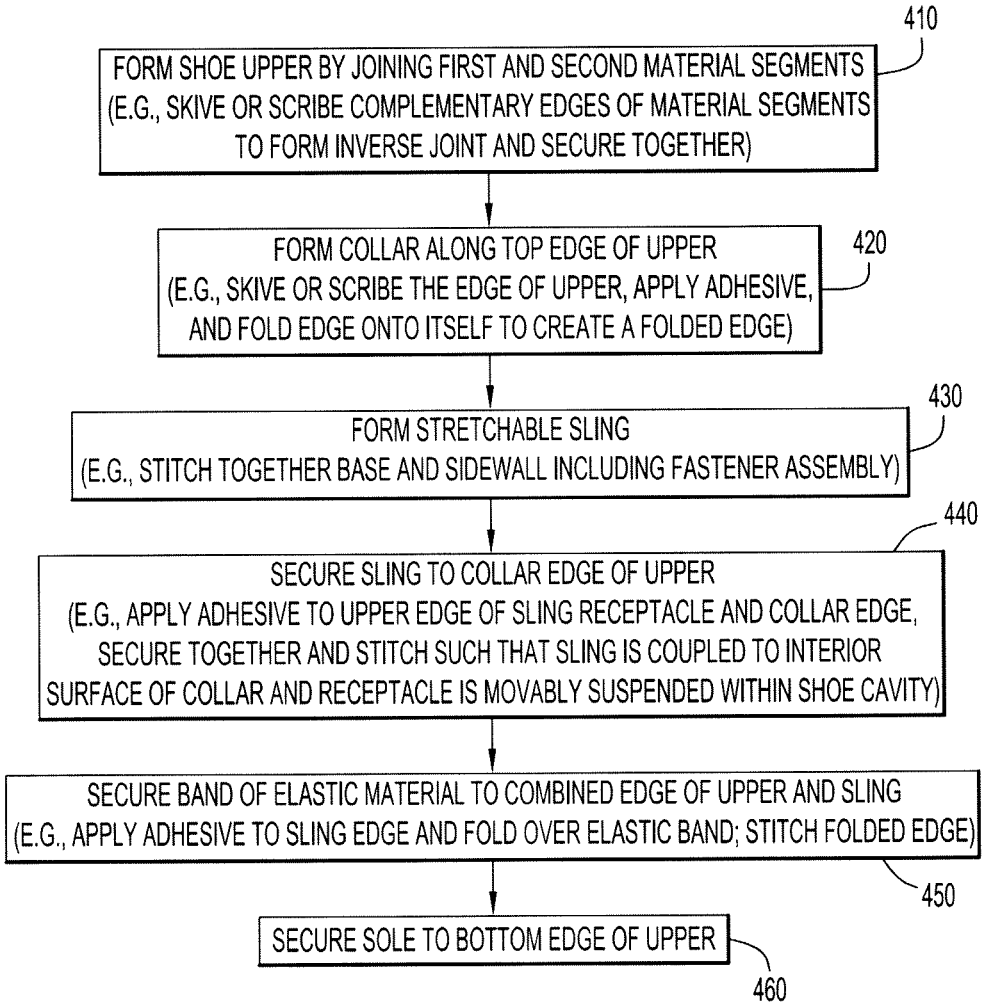
FIG. 4 is a flow diagram showing the steps of forming the shoe shown in FIG. 1A.

Referring to the embodiment shown in FIG. 3, the sling 200 may be secured to the upper 105 such the receptacle 210 is suspended and/or draped within the shoe cavity 315. Specifically, the upper edge of the receptacle sidewall 230 is fixed to collar 155, but the base 225 is permitted to move within the shoe cavity 315. By way of example, the upper portion of the receptacle 210 may be secured to the collar 155 via stitching, adhesive, etc. With this configuration, only the upper portion or edge of the side wall 230 is secured about the circumference of the collar 155, thereby enabling the receptacle 210 to hang freely from the collar while remaining positioned within the shoe cavity 315. Stated another way, the base 225 of the receptacle 210 is not permanently or temporarily secured to the sole 110 or the upper 105; consequently, the base of the receptacle moves freely move relative to the sole 110 (e.g., along the surface of the insole 300). With this configuration, the portion of the sling 200 that cradles the foot is adapted to move within the shoe cavity, while remaining securely coupled to the upper 105.

In other embodiments, the sling 200 may be secured to the shoe 100 (i.e., to the upper 105 and/or the sole 110) at other predetermined locations including, but not limited to, the forward point of the shoe (e.g., along the toe cap 120).

As best seen in FIG. 3, the uppermost portion 265 of the receptacle side wall 230 may be further configured extend slightly above the collar 155 of the upper 105 to provide additionally comfort to the wearer (to prevent chafing of the collar 105 against the foot).

The materials forming the shoe 100 are not particularly limited, and include natural and synthetic materials. By way of example, the upper 105 may be formed of flexible material such as leather such (e.g., patent leather or suede). The sling 200 may be formed of soft, elastic (stretchable) material such as LYCRA. The sole 110 may be formed from generally rigid and/or durable materials such as rubber or wood.

The method of forming the shoe 100 is now explained with reference to FIGS. 4 and 5A-5C. At Step 410, the upper 105 is formed. Referring to FIG. 5A, the upper 105 may include a first segment of material 500A and a second segment of material 500B. Each material segment 500A, 500B possesses an interior surface 505 (i.e., a surface that faces the interior of the shoe 100) and an exterior surface 510 (i.e., a surface that faces outward). The first material segment 500A may be a generally arcuate segment including a first or forward transverse side 515A, a second or rearward transverse side 515B, a first or sole-facing longitudinal side 520A, and a second or collar-forming longitudinal side 520B. The portion of the first segment 500A including the first transverse edge 515A may be a hooked end 522 that defines a generally J-shaped structure.

The second material segment 500B may include a third or forward transverse end 525A, a fourth or rearward transverse end 525B, a third or sole-facing longitudinal side 530A, and a fourth or collar-forming longitudinal side 530B.

To form the upper, the transverse ends 515A, 515B, 525A, 525B of the material segments 500A, 500B may be connected together by scribing or skiving complementary portions of the interior-facing 505 or exterior-facing 510 surfaces and securing the scribed edges together utilizing an adhesive and/or stitching. In one embodiment, the interior surface 505 of the first material segment 500A is scribed along its first transverse side 515A. Similarly, the exterior surface 510 of the second material segment 500B is scribed along the third transverse side 520A. This creates an inverse joint 532 having a size of, e.g., about 5-6 mm. The first 515A and third 525A transverse sides are then sealed together utilizing an adhesive (e.g., a hot melt polyurethane adhesive). In addition, the second 515B and fourth 525B transverse sides may be connected along seam 532 to form the heel portion 140 of the upper 105, defining the central counter position. Once sealed, the upper 105 may be generally in the form of an oval having a top or collar edge 540 and a bottom or sole edge 545 is formed.

At Step 420, the collar 155 may be formed. By way of example, the collar edge of the upper 105 may be folded along fold lines 550 to form a folded over band or cuff.

At Step 430, the sling 200 is formed. By way of example a piece of stretchable material may be configured into the base 225, side wall 230, and fastener assembly 215 portions (e.g. by cutting a single piece of fabric or cutting multiple pieces of fabric together via stitching, etc.). The sling 200 may then be secured to the collar 105 of the upper at Step 440. Specifically, the outer surface of the exterior flap 245 extending from the rim of the receptacle 210 is secured to the interior surface 505 of the upper 105, and the receptacle is positioned within the upper. Optionally, the elastic band 560 may be inserted into the pocket 249 formed between the downward flap 245 and the receptacle exterior wall at Step 450. The pocket 249 may be sealed shut in a manner that secures the sling 200 to the upper 105 (e.g., by stitching) as described above. The elastic band 560 assists in stabilizing the shoe 100 on the foot, more securely connecting it to the foot of the wearer.

At step 460, the sole 110 is secured to the bottom edge 545 of the upper 105 utilizing conventional techniques (e.g., via stitching, adhesive, etc.) to form the joint 165. Once formed, the upper 105 is positioned above the sole 110, defining one or more of the toe cap, throat, vamp, quarter, heel cap portions of the shoe 100 as described above.

In one embodiment, reinforcement material may be added to selected portions of the interior surface 505 of the upper 105. For example, reinforcing material (e.g., fabric such as canvas) may be secured to the interior surface 505 of the toe cap 120 of the upper 105 utilizing adhesive. In addition, reinforcing material may be secured to the interior side of the heel (to form the counter), e.g., by sewing and/or adhesive, and then optionally hammered until smooth. Reinforcement material may also be connected to the bottom edge 545 of the upper 105 (e.g., via adhesive and stitching).

Figure 6:
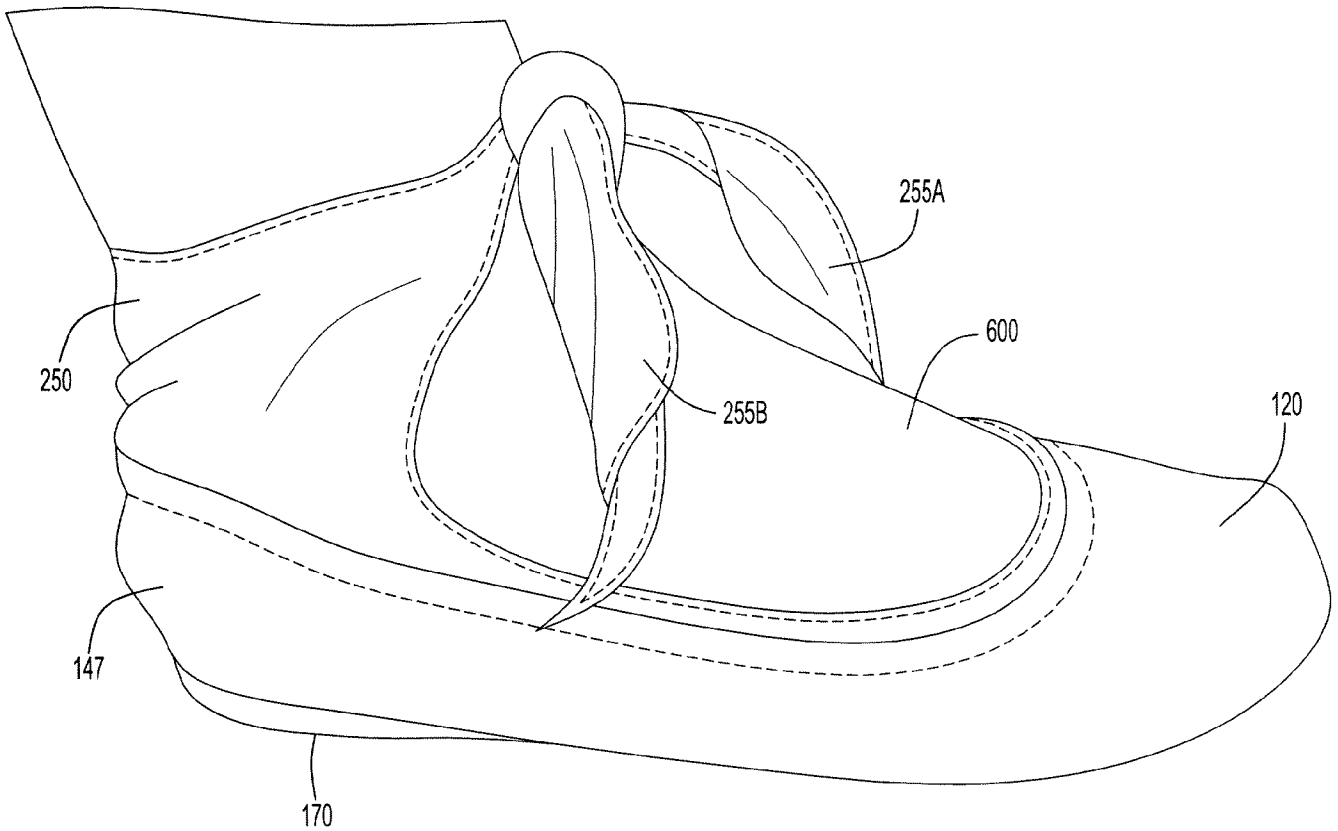
FIG. 6 illustrates the shoe of FIG. 1A positioned on the foot of a wearer.

Referring to FIG. 6, in operation, a user inserts a foot 600 into the shoe 100, through the opening 160 defined by the collar 155 and into the sling cavity 240. As the foot is positioned within the shoe, the foot receptacle 210 of the sling stretches and conforms to the foot 600, providing a customized fit to the wearer. In addition, the upper portion of the receptacle 210 remains fixed to the collar 155 while the base 225 moves freely with the user's foot.

Once the foot is inserted into the shoe, fastener assembly 220 is secured to the ankle/leg. Specifically, the central web 250 is positioned such that it covers the Achilles tendon of the foot. The first fastener member 255A is wrapped around one side of the ankle/leg, while the second fastener member 255B is wrapped around the other side of the ankle/leg. The distal portions 260A, 260B of the fasteners 255A, 255B are then secured to each other (e.g., mechanically secured by tying), being fastened along the front of the leg/ankle, generally opposite the central web position. Securing the fastening members further helps to secure the shoe 100 to the foot 600.

The above-described method provides a shoe having an internal, integrated sling or lining member with increased comfort characteristics. The sling not only provides additional comfort for the wearer, reducing friction between the foot and the interior surface of the shoe upper and sole, but also stabilizes the shoe on the foot. The sling permits the wearer to completely flex the foot in all required directions while securing the shoe tightly to the foot. The sling is easy to secure, and flexes to accommodate the movement of the foot.

Figure 7:
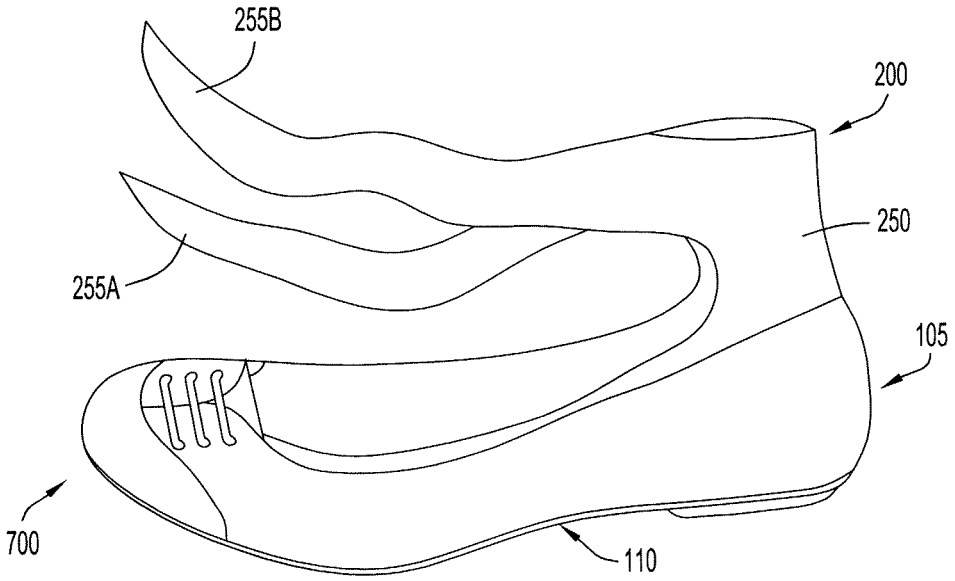
FIG. 7 illustrates a side view of shoe in accordance with another embodiment of the invention.
Figure 8:
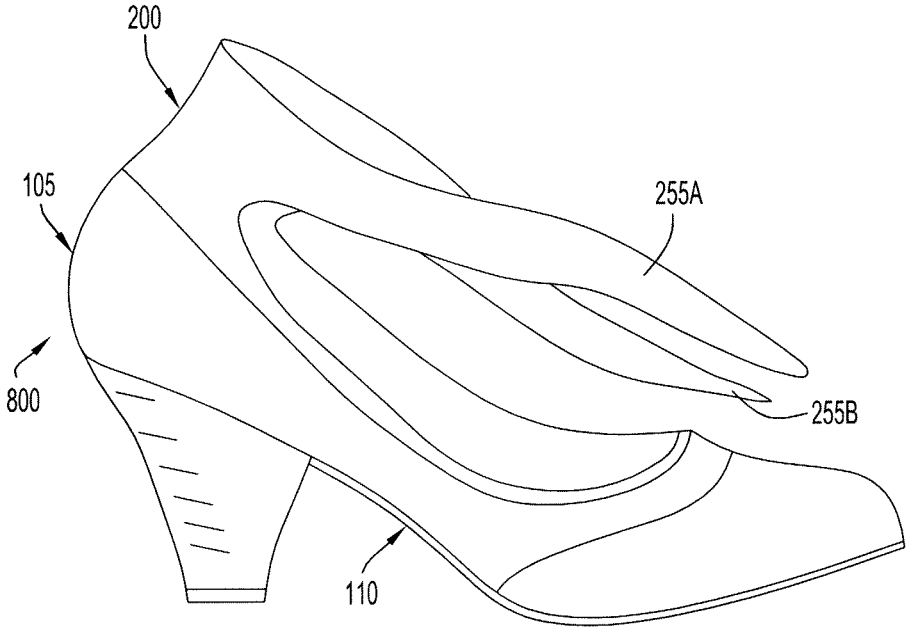
FIG. 8 illustrates a side view of shoe in accordance with another embodiment of the invention.

While the present invention has been described in detail and with reference to specific embodiments thereof, it will be apparent to one skilled in the art that various changes and modifications can be made therein without departing from the spirit and scope thereof. For example, the materials forming the shoe 200 may include any suitable for its described purpose. The type of shoe 100 in which the sling 200 is integrated is not particularly limited. That is, the method may be utilized to form shoes other than the shoes illustrated. Referring to FIGS. 7 and 8, other embodiments of the shoe includes low-heeled 700 (FIG. 7) and high-heeled shoes 800 (FIG. 8).

In addition, the sling 200 may include only the receptacle 210 portion, with the fastener assembly 215 being omitted. Thus, the 200 sling would terminate along its upper rim. The sling 200 may be formed of a unitary piece of fabric, or may be formed of multiple pieces of fabric secured together. For example, the receptacle 210 and the fastener assembly 215 may be formed as separate components and combined via sewing, adhesive, etc. Similarly, individual components of each of the receptacle 210 (e.g., the base and side wall) and the fastener assembly 215 (e.g., the fastener members 255A, 255B and the central web 250) may be formed as a unitary structure or may be individual units secure together.

Any number of segments of material pieces 500A, 500B may be utilized to form the upper 105. While the illustrated embodiments show two segments of material, the upper 105 may be formed of a single segment of material.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

I claim:

1. A shoe comprising:

an upper including:

a top portion defining a collar, and a bottom portion defining a sole edge;

a sole coupled to bottom portion of the upper, the sole comprising an insole surface, wherein the sole and the upper cooperate to define a shoe cavity operable to receive a foot; and a flexible lining member comprising:

a base configured to be disposed over the sole;

a sidewall extending distally from the base, wherein the base and the sidewall cooperate to form a foot receptacle; and a flap extending from a rim of the foot receptacle and secured to an interior surface of the upper and secured to the sidewall, wherein the flap is configured to define a pocket, and disposed within the pocket is an elastic band, wherein a distal portion of the sidewall is permanently affixed to the collar of the upper such that the flexible lining member is movably suspended from the collar and positioned within the shoe cavity, and the collar does not extend into the foot receptacle.

2. The shoe of claim 1, wherein the base of the flexible lining member is freely movable along the insole surface while the sidewall is fixed to the top portion of the upper.

3. The shoe of claim 1, wherein the flexible lining member is formed of stretchable material and is configured to conform to the foot received by the shoe cavity.

4. The shoe of claim 1, wherein the flexible lining member includes:

a fastener assembly extending outward from the collar of the upper, wherein the fastener assembly is configured to wrap around a leg of a wearer.

5. The shoe of claim 4, wherein the fastener assembly comprises:

a central web including a first lateral side and a second lateral side, a first fastener member extending from the first lateral side of the central web; and a second fastener member extending from the second lateral side of the central web.

6. The shoe of claim 5, wherein the first fastener member and the second fastener member are selectively securable to each other.

7. The shoe of claim 4, wherein:

the upper comprises a heel portion including a counter generally disposed along a longitudinal axis of the shoe; and the fastener assembly extends from the collar such that an ankle fastener is oriented above the counter of the upper.

8. A method of forming a shoe, the method comprising:

(a) forming an upper having a top portion including a top edge and a bottom portion including a bottom edge;

(b) permanently affixing a lining member to the top portion of the upper, wherein the lining member is configured to receive a foot, and the lining member comprises a flap extending from a rim of a foot receptacle, wherein the foot receptacle is formed by the lining member comprising a base configured to be disposed over a sole and a sidewall extending distally from the base, and the flap is secured to an interior surface of the upper to define a pocket along a shoe-facing side of the lining member;

(c) positioning an elastic member within the pocket; and (d) securing the sole to the bottom portion of the upper to form the shoe, wherein the upper and the sole cooperate to define a shoe cavity, wherein the lining member is secured to the upper such that the lining member is movably suspended within the shoe cavity, and the upper does not extend into the foot receptacle.

9. The method claim 8, wherein the lining member includes:

a foot receptacle disposed within the shoe cavity; and a fastener formed integrally with the foot receptacle, wherein the fastener extends distally from the top edge of the upper.

10. The method of claim 9, wherein the fastener comprises:

a central web including a first lateral side and a second lateral side;

a first fastener member extending from the first lateral side of the central web; and a second fastener member extending from the second lateral side of the central web.

11. The method of claim 8, wherein:

a distal portion of the sidewall is secured to the top portion of the upper; and the method further comprises securing an elastic member to each of the top portion of the upper and the distal portion of the lining member.

12. A method of connecting a shoe to a foot of a wearer, the method comprising:

(a) obtaining a shoe comprising:

an upper having a top portion including a top edge and a bottom portion including a bottom edge, the top portion defining a collar of the shoe, a sole coupled to the bottom portion of the shoe, wherein the sole and the upper cooperate to define a shoe cavity, and a lining member permanently affixed to the shoe collar such that it is suspended within the shoe cavity, and the collar does not extend into a foot receptacle, wherein the foot receptacle is formed by the lining member comprising a base configured to be disposed over the sole and a sidewall extending distally from the base, and the lining member comprise a flap extending from a rim of the foot receptacle and secured to an interior surface of the upper, wherein the flap is configured to define a pocket with an elastic band disposed within the pocket; and (b) inserting the foot into the shoe via the collar.

13. The method claim 12, wherein the sole comprises an insole;

the foot receptacle is disposed within the shoe cavity;

a distal portion of the sidewall is secured to the top portion of the upper; and the base freely moves over the insole.

14. The method of claim 13, wherein:

the lining member further comprises a fastening member formed integrally with the foot receptacle;

the fastening member comprises:

a central web including a first lateral side and a second lateral side, a first fastener member extending from the first lateral side of the central web, and a second fastener member extending from the second lateral side of the central web; and the method further comprises:

positioning the central web of the fastening member such that the central web is disposed over the Achilles tendon portion of the foot.

15. The method of claim 14 further comprising: wrapping the first fastener member and the second fastener member about an ankle of the wearer and securing the first fastener member to the second fastener member.

16. The shoe of claim 1, wherein:

the upper comprises a heel portion including a counter generally disposed along a longitudinal axis of the shoe; and the flexible lining member further includes a fastener assembly that extends outward from the collar proximate the counter.

17. The shoe of claim 16, wherein:

the fastener assembly comprises a unitary structure including:

a central web generally centrally disposed proximate the counter, a first fastener member extending from a first lateral side of the central web, and a second fastener member extending from a second lateral side of the central web;

and the first fastener member and the second fastener member are configured to wrap around respective lateral sides of an ankle, the first fastener member and the second fastener member being securable to each other.

18. The shoe of claim 17, wherein the first fastener member is configured to be tied to the second fastener member.

* * * * *